US012351276B2

(12) United States Patent
L'Heureux et al.

(10) Patent No.: US 12,351,276 B2
(45) Date of Patent: Jul. 8, 2025

(54) TOW ATTACHMENT, TOW PYLON ASSEMBLY AND WATERCRAFT HAVING SAME

(71) Applicant: BOMBARDIER RECREATIONAL PRODUCTS INC., Valcourt (CA)

(72) Inventors: Marc-Andre L'Heureux, Bromont (CA); Abdelkarim Meskine, Valcourt (CA); Alexandre Bouchard, Drummondville (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 650 days.

(21) Appl. No.: 17/585,090

(22) Filed: Jan. 26, 2022

(65) Prior Publication Data

US 2022/0234691 A1 Jul. 28, 2022

Related U.S. Application Data

(60) Provisional application No. 63/142,743, filed on Jan. 28, 2021.

(51) Int. Cl.

| | |
|---|---|
| ***B63B 21/56*** | (2006.01) |
| ***B63B 21/04*** | (2006.01) |
| ***B63B 21/20*** | (2006.01) |

(52) U.S. Cl.

CPC ..... *B63B 21/56* (2013.01); *B63B 21/04* (2013.01); *B63B 21/20* (2013.01); *B63B 2021/566* (2013.01)

(58) Field of Classification Search

CPC ..... B63B 21/00; B63B 21/04; B63B 21/20; B63B 21/56; B63B 2021/566

USPC ..... 114/244

See application file for complete search history.

(56) References Cited

U.S. PATENT DOCUMENTS

| | | | | |
|---|---|---|---|---|
| 4,893,577 | A * | 1/1990 | Jennings | B63B 34/67 114/253 |
| 5,018,474 | A * | 5/1991 | Jellen | B63B 34/67 114/253 |
| 5,699,823 | A * | 12/1997 | Thomson | F16L 55/1007 137/68.15 |
| 7,128,014 | B2 | 10/2006 | Berthiaume et al. | |
| 9,340,260 | B2 * | 5/2016 | Yeames | B63B 21/04 |
| 9,550,550 | B1 | 1/2017 | Housman | |
| 10,246,168 | B1 | 4/2019 | Stohler et al. | |

(Continued)

OTHER PUBLICATIONS

Bullet Release, by Travis Heffron LLC, http://bulletrelease.com/index.php., Retreived on Jan. 26, 2022.

*Primary Examiner* — Lars A Olson
(74) *Attorney, Agent, or Firm* — BCF LLP

(57) ABSTRACT

A tow attachment for a watercraft is disclosed. The tow attachment is configured to attach a tow rope to the watercraft, and has a first part and a second part that is connected to the first part by a connecting portion. The first part is configured for rigid connection to the watercraft, and the second part is configured to attach to the tow rope. The second part disconnects from the first part about the connecting portion in response to the tow rope applying a load above a predetermined load to the second part. A tow pylon assembly having a tow pylon and the tow attachment connected to the tow pylon is also disclosed. A watercraft with the tow attachment and a watercraft with the tow pylon assembly are also disclosed.

22 Claims, 14 Drawing Sheets

(56) References Cited

U.S. PATENT DOCUMENTS

| | | | | |
|---|---|---|---|---|
| 11,014,671 | B2 * | 5/2021 | Gallo | B64D 3/00 |
| 2006/0185571 | A1 | 8/2006 | Leseberg | |
| 2006/0185572 | A1 | 8/2006 | Leseberg | |

* cited by examiner

TOW ATTACHMENT, TOW PYLON ASSEMBLY AND WATERCRAFT HAVING SAME

CROSS-REFERENCE TO RELATED APPLICATION

The present application claims priority to U.S. Provisional Patent Application No. 63/142,743, filed Jan. 28, 2021 entitled "Tow Attachment, Tow Pylon Assembly and Watercraft Having Same", which is incorporated by reference herein in its entirety.

TECHNOLOGICAL FIELD

The present technology relates to tow attachments for watercraft, watercraft having a tow attachment, tow pylon assemblies for watercraft and watercraft having a tow pylon assembly.

BACKGROUND

Some watercraft have tow attachments connected at a rear thereof to which tow ropes can be attached, thereby providing a tow point that can be used for a variety of tow activities such as water tubing or waterskiing. Other watercraft have tow pylons, which provide an elevated tow point that can be desirable for certain tow sports such as wakeboarding and/or wake surfing.

Products exist that provide a mechanical fuse intended to break when a load above a predetermined load is applied on the tow rope. Some such products are attached in series between the tow point and a forward end of the tow rope, and are designed to break at a tension load lower than that of a conventional tow rope.

However, current products can require additional steps to be completed prior to engaging in tow activities. Such steps may be bypassed or forgotten.

In view of the foregoing, there is a desire for a product that addresses at least some of these drawbacks.

SUMMARY

It is an object of the present technology to ameliorate at least some of the inconveniences present in the prior art.

According to one aspect of the present technology, there is provided a tow attachment for a watercraft, that is configured to attach a tow rope to the watercraft. The tow attachment includes a first part and a second part. The first part is configured for rigid connection to the watercraft, and the second part is connected to the first part by a connecting portion. The second part is configured to attach to the tow rope. The second part disconnects from the first part about the connecting portion in response to the tow rope applying a load above a predetermined load to the second part.

In some embodiments, the connecting portion defines a mechanical sacrificial part such that the second part breaks away from the first part about the connecting portion in response to the tow rope applying the load above the predetermined load to the second part.

In some embodiments, the connecting portion has a lower breaking strength than the first and second parts.

In some embodiments, the first part, the second part and the connecting portion are integral.

In some embodiments, the second part is a bollard.

In some embodiments, the first part, the second part, and the connecting portion each have a circular perimeter; and a minimum diameter of the connecting portion is smaller than minimum diameters of the first and second parts.

In some embodiments, a minimum wall thickness of the connecting portion is smaller than minimum wall thicknesses of the first and second parts.

In some embodiments, the first part, the second part, and the connecting portion each have annular cross-sections. The minimum wall thickness of the connecting portion corresponds to a smallest thickness of the annular cross-section of the connecting portion, the minimum wall thickness of the first part corresponds to a smallest thickness of the annular cross-section of the first part, and the minimum wall thickness of the second part corresponds to a smallest thickness of the annular cross-section of the second part.

According to another aspect of the present technology, there is provided a watercraft having a hull, a deck disposed on the hull, and a tow attachment according to at least one of the above aspects or according to at least one of the above aspects and one or more of the above embodiments connected to at least one of the hull and the deck.

In some embodiments, the watercraft further has a tow pylon that is connected to the at least one of the hull and the deck, and the first part of the tow attachment is rigidly connected to the tow pylon.

In some embodiments, the watercraft further has a bracket connected to the at least one of the hull and the deck, and the tow pylon is connected to the bracket.

In some embodiments, the tow pylon is removably connected to the bracket.

In some embodiments, the tow pylon has a lock that selectively locks the tow pylon to the bracket.

According to another aspect of the present technology, there is provided tow pylon assembly for a watercraft that has a tow pylon and a tow attachment. The tow attachment is connected to the tow pylon, and is configured to attach a tow rope to the watercraft. The tow attachment includes a first part and a second part. The first part is configured for rigid connection to the tow pylon. The second part is connected to the first part by a connecting portion, and is configured to attach to the tow rope. The second part disconnects from the first part about the connecting portion in response to the tow rope applying a load above a predetermined load to the second part.

In some embodiments, the connecting portion defines a mechanical sacrificial part such that the second part breaks away from the first part about the connecting portion in response to the tow rope applying the load above the predetermined load to the second part.

In some embodiments, the connecting portion has a lower breaking strength than the first part, the second part and the tow pylon.

In some embodiments, the first part, the second part and the connecting portion are integral.

In some embodiments, the second part is a bollard.

In some embodiments, the first part, the second part, and the connecting portion each have a circular perimeter; and a minimum diameter of the connecting portion is smaller than minimum diameters of the first and second parts.

In some embodiments, a minimum wall thickness of the connecting portion is smaller than minimum wall thicknesses of the first and second parts.

In some embodiments, the first part, the second part, and the connecting portion each have annular cross-sections. The minimum wall thickness of the connecting portion corresponds to a smallest thickness of the annular cross-section of the connecting portion, the minimum wall thickness of the first part corresponds to a smallest thickness of the annular cross-section of the first part, and the minimum wall thickness of the second part corresponds to a smallest thickness of the annular cross-section of the second part.

In some embodiments, the tow attachment is selectively connected to the tow pylon.

In some embodiments, the tow pylon assembly further includes a bracket configured to be connected to at least one of a hull and a deck of the watercraft, and the tow pylon is connected to the bracket.

In some embodiments, the tow pylon is removably connected to the bracket.

In some embodiments, the tow pylon includes a lock that selectively locks tow pylon to the bracket.

According to another aspect of the present technology, there is provided a watercraft having a hull, a deck disposed on the hull, and the tow pylon assembly according to at least one of the above aspects or according to at least one of the above aspects and one or more of the above embodiments connected to at least one of the hull and the deck.

For purposes of the present application, terms related to spatial orientation when referring to a watercraft and components in relation to the watercraft, such as "vertical", "horizontal", "forwardly", "rearwardly", "left", "right", "above" and "below", are as they would be understood by a driver of the watercraft sitting thereon in an upright driving position, with the watercraft being at rest and level.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
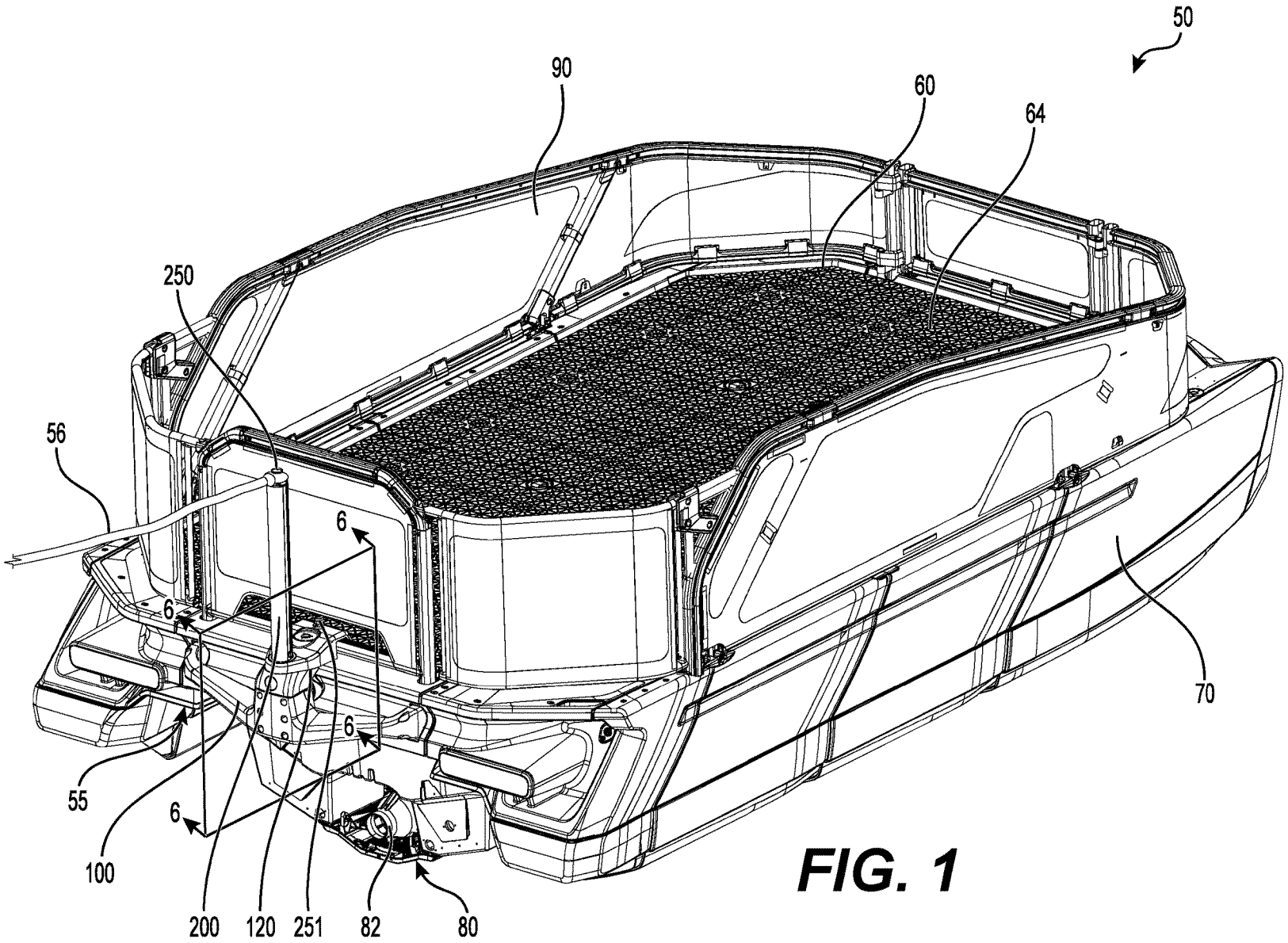
FIG. 1 is a perspective view taken from a rear, top, right side of a watercraft with a tow pylon assembly including a tow attachment.
Figure 2:
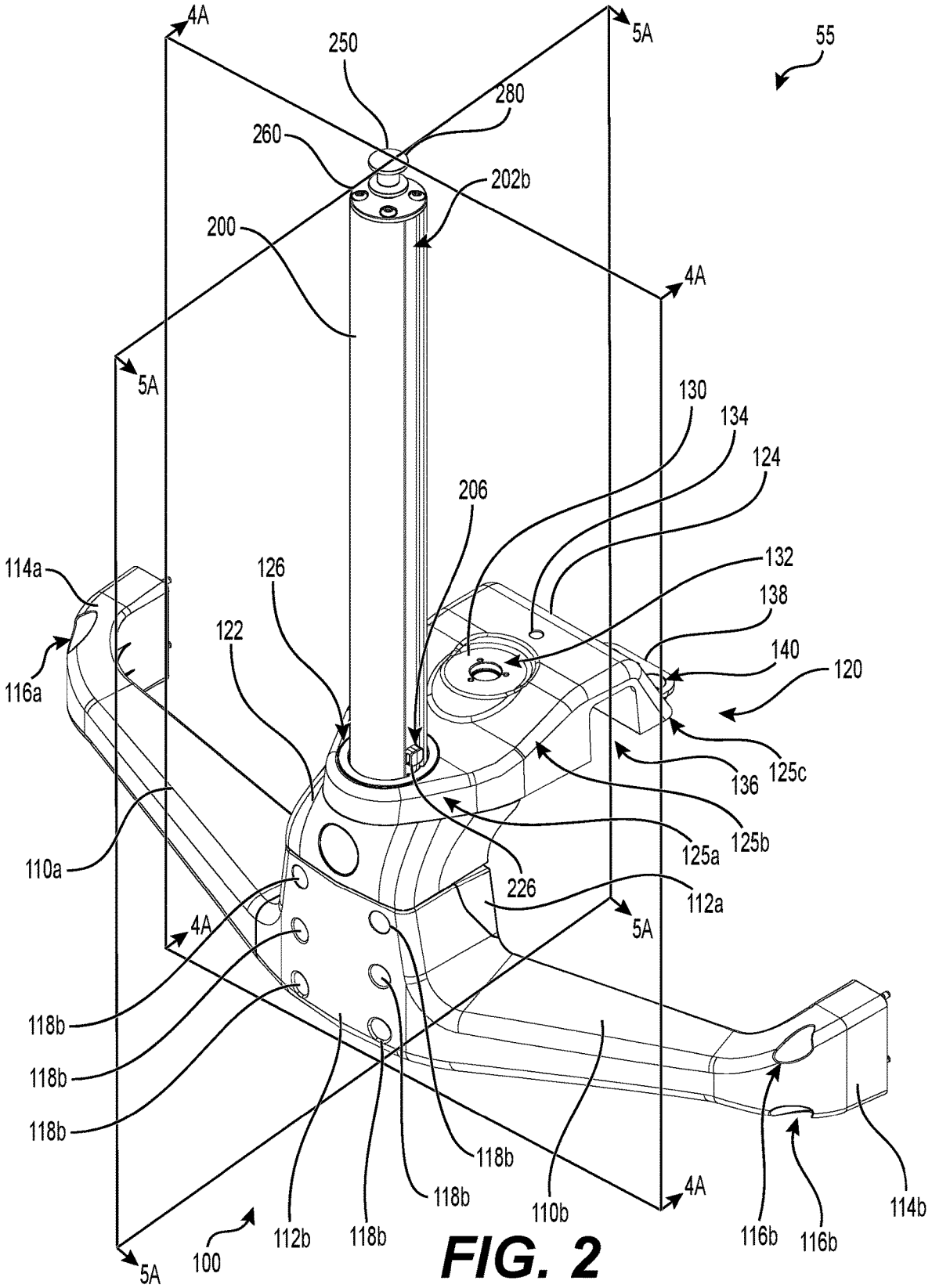
FIG. 2 is a perspective view taken from a rear, top, right side of the tow pylon assembly of FIG. 1.
Figure 3:
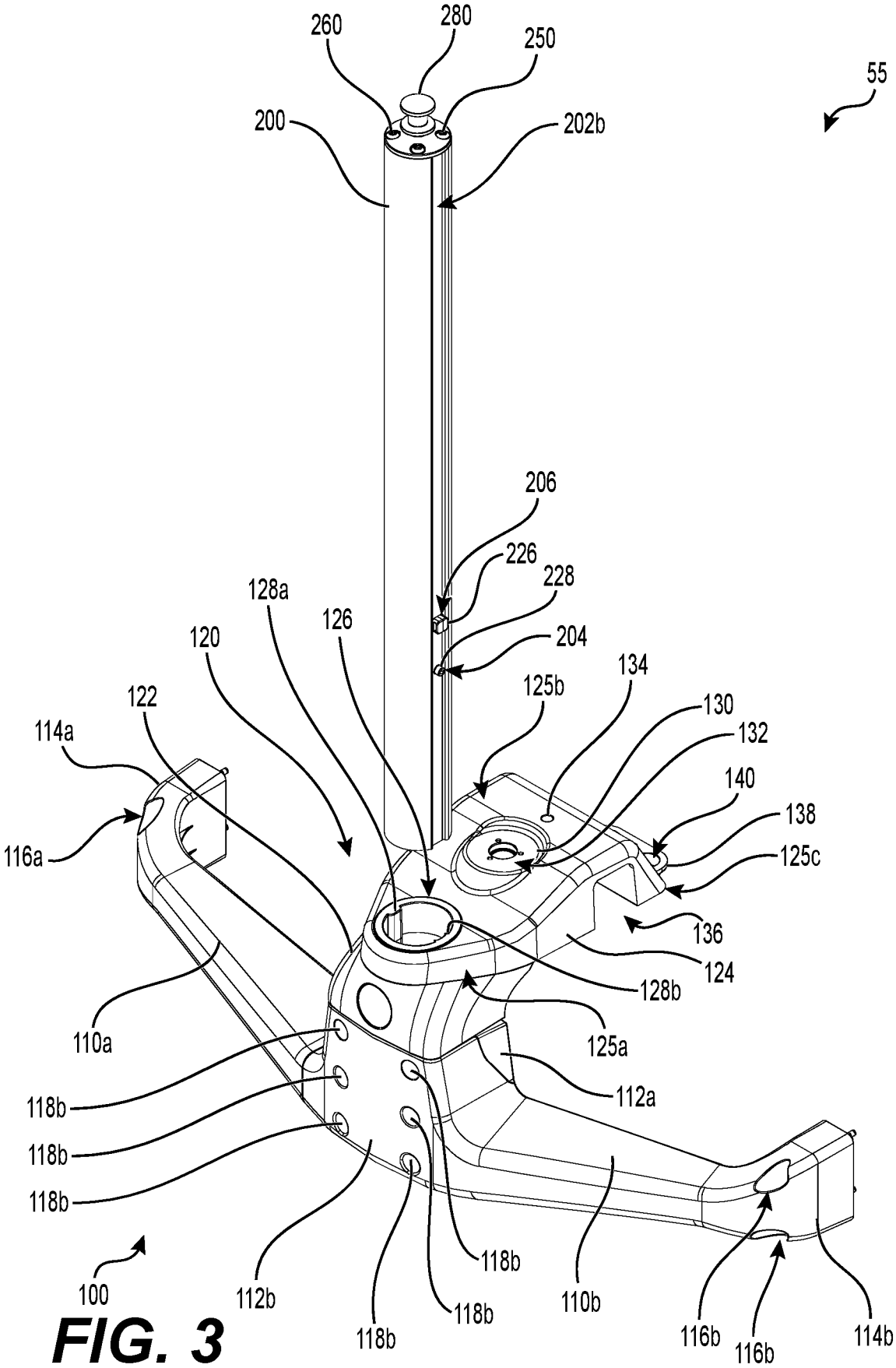
FIG. 3 is a partially exploded perspective view taken from the rear, top right side of the tow pylon assembly of FIG. 1.
Figure 4A:
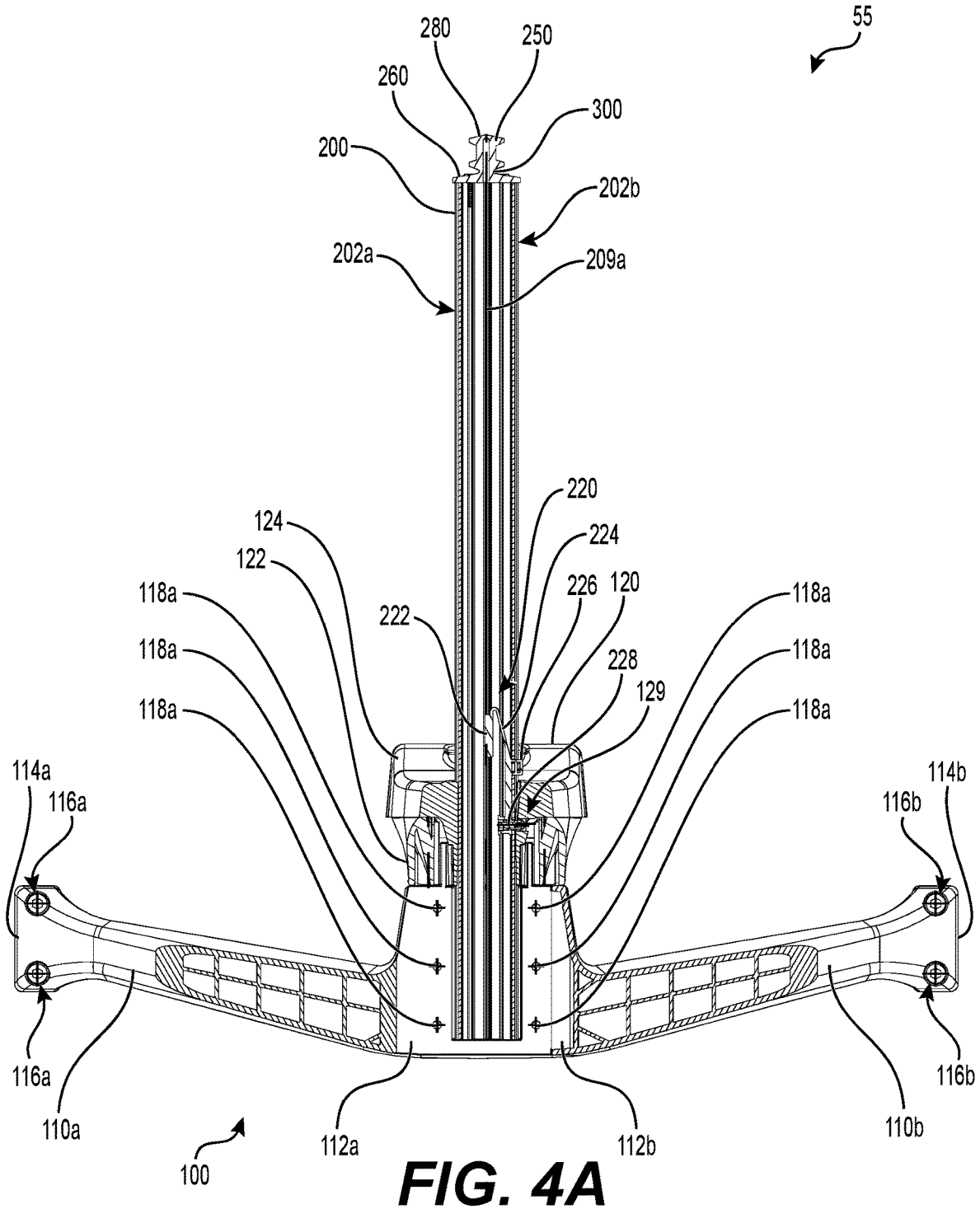
FIG. 4A is a cross-sectional view of the tow pylon assembly of FIG. 1, taken through the plane 4A-4A of FIG. 2.
Figure 4B:
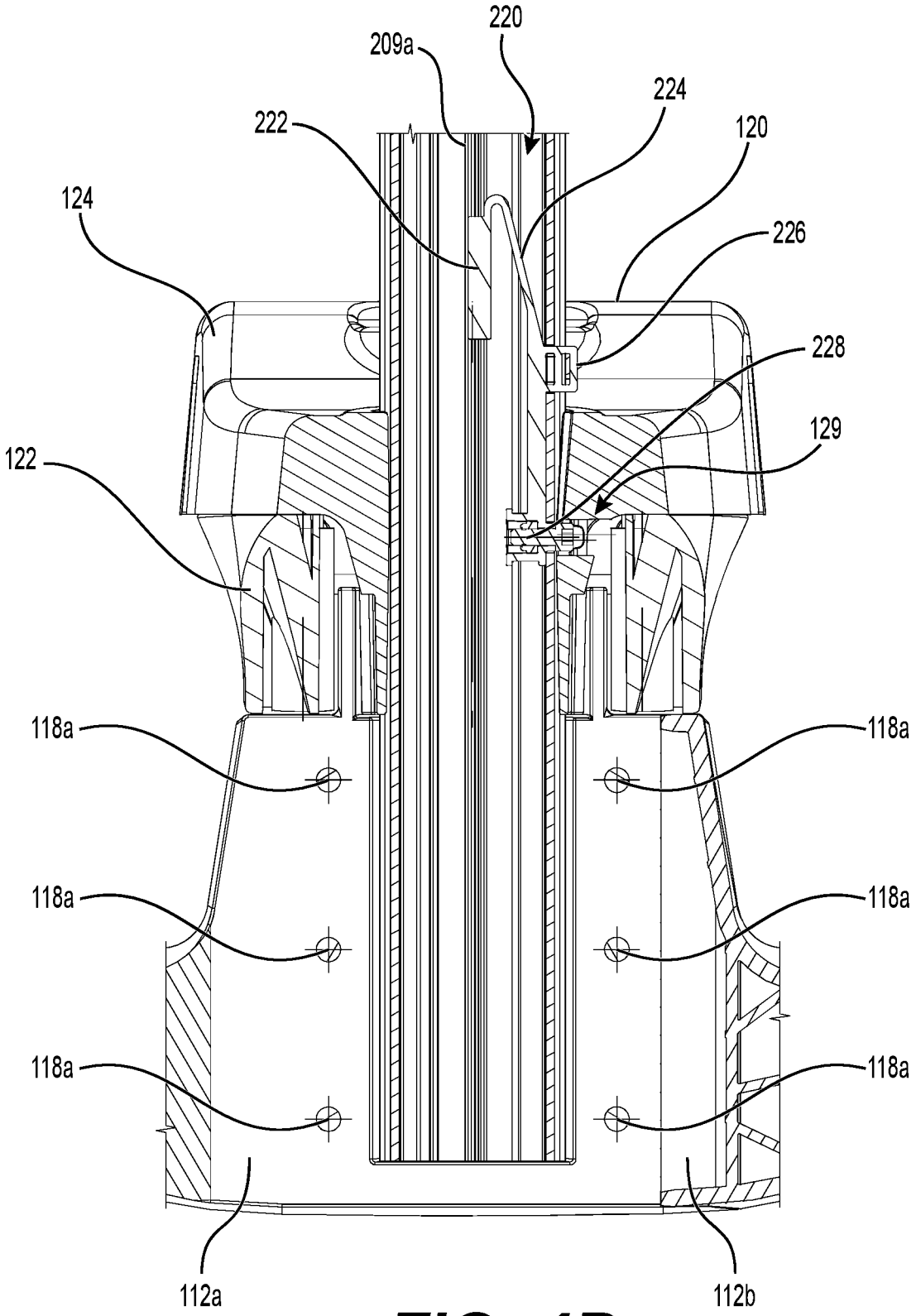
FIG. 4B is a close-up view of a portion of the cross-sectional view of FIG. 4A.
Figure 5A:
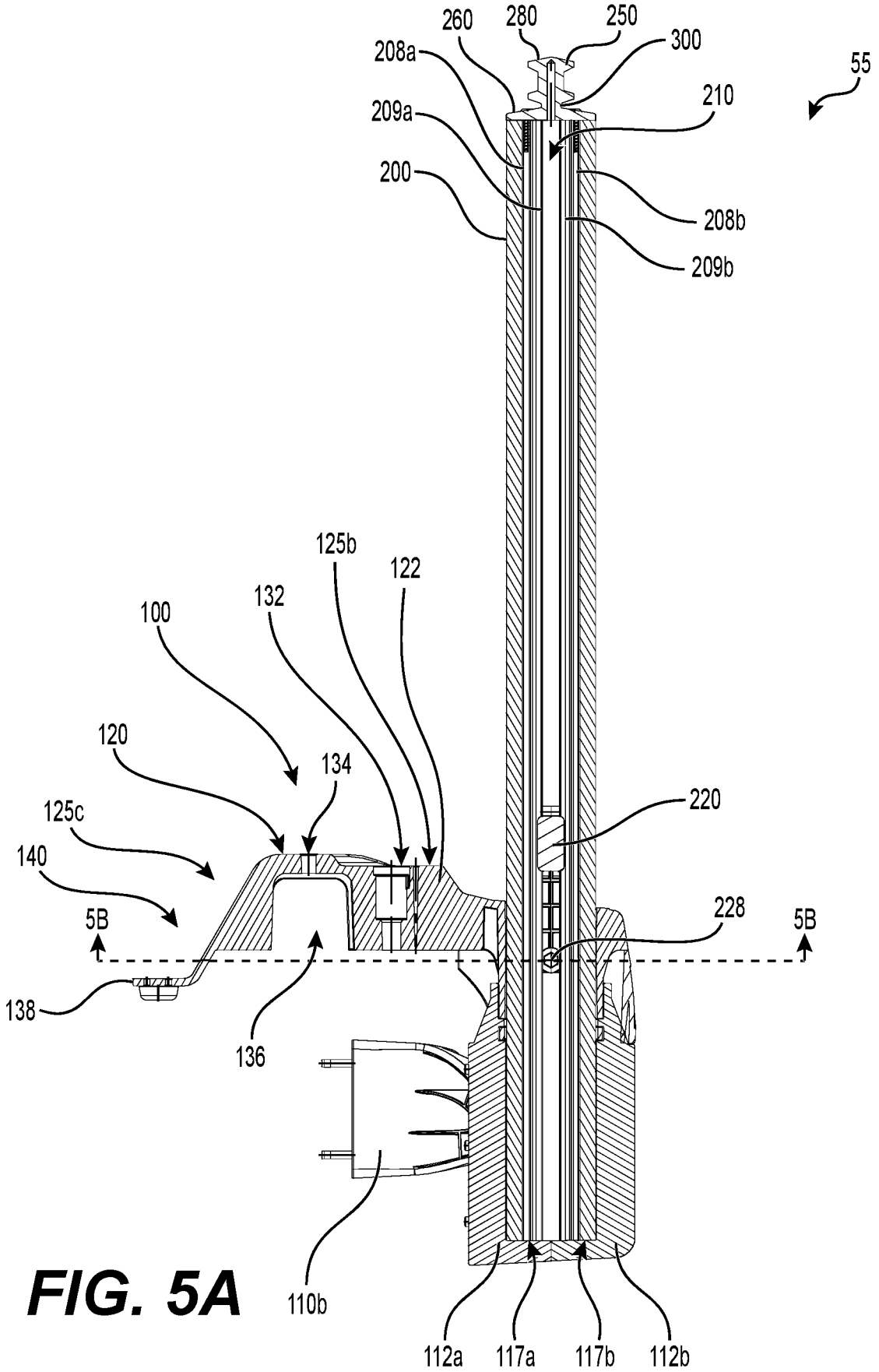
FIG. 5A is a cross-sectional view of the tow pylon assembly of FIG. 1; taken through plane 5A-5A of FIG. 2.
Figure 5B:
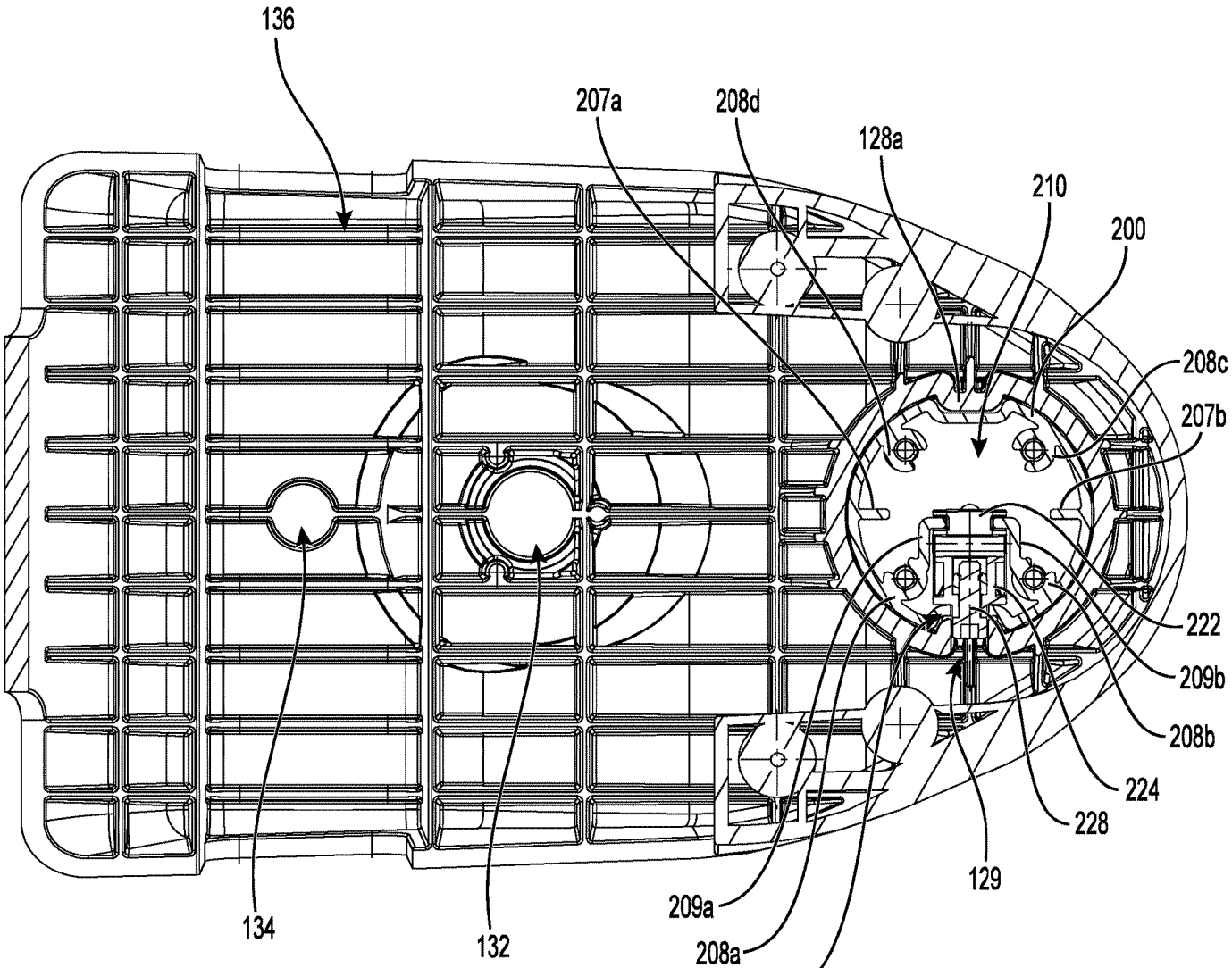
FIG. 5B is a cross-sectional view of the tow pylon assembly of FIG. 1, taken through line 5B-5B of FIG. 5A.

A watercraft 50 with a tow pylon assembly 55 in accordance with an embodiment of the present technology is shown in FIG. 1. The tow pylon assembly 55 has a bracket 100, a tow pylon 200 and a tow attachment 250 that is configured to attach a tow rope 56 to the watercraft 50. Thus, one end of the tow rope 56 is connected to the tow attachment 250, and another end is connected to an object being towed (not shown) or held by a person being towed. The following description relates to one example of a watercraft 50, notably a pontoon boat 50. Those of ordinary skill in the art will recognize that there are other known types of watercraft incorporating different designs, such as personal watercraft, and that the present technology could encompass these other watercraft.

The boat 50 has a deck 60 and a hull 70. The deck 60 is disposed on the hull 70, and is supported thereby. The deck 60 has an upper surface 64 for supporting occupants, as well as accessories and accommodations of the boat 50 (e.g., seating, command console, etc., not shown).

The boat 50 is propelled by a jet propulsion system 80 powered by a motor (not shown). The jet propulsion system 80 has a steering nozzle 82 used for steering the boat 50. A steering device, such as a handlebar or a steering wheel (not shown), is operatively connected to the steering nozzle 82. A throttle lever (not shown) is operatively connected to the motor for controlling operation of the motor. The steering device and the throttle lever are located on a command console (not shown) provided on the deck 60. It is contemplated that other propulsion systems, such as a stern drive, marine outboard engine or marine inboard engine, could be used to propel the boat 50. It is also contemplated that that the steering nozzle 82 could be replaced by one or more rudders. A powerpack (not shown) of the boat 50, including the jet propulsion system 80 and the motor, is enclosed in part by the hull 70.

The boat 50 has a side structure 90 surrounding at least part of the deck 60 and extending upwardly therefrom. In the present embodiment, the side structure 90 is a barrier structure 90. It is contemplated that that in some embodiments, the side structure 90 could be gunnels of the boat 50 or another structure extending vertically from the upper surface 64. The barrier structure 90 is located along a periphery of the boat 50 (as defined by the deck 60). The barrier structure 90 generally surrounds the entirety of the deck 60. It is contemplated that, in other embodiments, the barrier structure 90 could only partially surround the deck 60.

Referring to FIGS. 2 to 9, the tow pylon assembly 55 will now be described in greater detail. Briefly, in the present embodiment, the tow attachment 250, which is configured to attach to the tow rope 56, is rigidly connected to the tow pylon 200. The tow pylon 200 is removably connected to the bracket 100, and the bracket 100 is connected to the boat 50. In some embodiments, the tow pylon 200 could be permanently connected to the bracket 100. In the present embodiment, the tow pylon assembly 55 also includes a secondary tow attachment 251 (shown in FIGS. 1 and 6) that is connected to the bracket 100.

The bracket 100 is connected to the rear of the boat 50. More precisely, the bracket 100 is connected to the hull 70 and to the deck 60. It is contemplated that in some embodiments, the bracket 100, and thus the tow pylon assembly 55, could be configured to connect only to the deck 60, or only to the hull 70. It is also contemplated that in some embodiments, the bracket 100 could be omitted, such that the tow pylon 200 and/or the tow attachment 250 could be directly connected to the boat 50.

Referring particularly to FIGS. 2 to 5B, the bracket 100 has a left arm 110*a*, a right arm 110*b*, and an upper part 120. The arms 110*a*, 110*b* and the upper part 120 are distinct parts that are connected to each other. It is contemplated that in other embodiments, the bracket 100 could be made of more or less than three parts. As will be described in greater detail below, the left and right arms 110*a*, 110*b* are complementary and connect to each other. The upper part 120 is connected to both of the arm connecting portions 112*a*, 112*b* and extends upwardly and forwardly therefrom.

The left arm 110*a* has an arm connecting portion 112*a* and a curved portion 114*a* that is laterally spaced, to the left, from the arm connecting portion 112*a* and in which two vertically spaced side apertures 116*a* are defined. The arm connecting portion 112*a* defines a recess 117*a* (FIG. 5A) at a center thereof. The arm connecting portion 112*a* also defines two sets of three vertically spaced connecting apertures 118*a*, where one set of the connecting apertures 118*a* is on the left side of the recess 117*a*, and the other set of the connecting apertures 118*a* is on the right side of the recess 117*b*. The connecting apertures 118*a* are configured to receive bolts therethrough.

Likewise, the right arm 110*b* has an arm connecting portion 112*b* and a curved portion 114*b* that is laterally spaced, to the right, from the arm connecting portion 112*b*, and in which two vertically spaced side apertures 116*b* are defined. The arm connecting portion 112*b* defines a recess 117*b* (FIG. 5A) at a center thereof. The arm connecting portion 112*b* defines two sets of three vertically spaced connecting apertures 118*b*, where one set of the connecting apertures 118*b* is on the left side of the recess 117*b*, and the other set of the connecting apertures 118*b* is on the right side of the recess 117*b*. The connecting apertures 118*b* are configured to receive bolts therethrough.

When the left and right arms 110*a*, 110*b* are connected to one another, the connecting apertures 118*a* are aligned with the connecting apertures 118*b*, and the recess 117*a* is aligned with the recess 117*b*, such that the left and right arm connecting portions 112*a*, 112*b* are flush, and the recesses 117*a*, 117*b* define a space configured to receive a bottom portion of the tow pylon 200. Bolts extending through the connecting apertures 118*a*, 118*b* connect the left and right arms 110*a*, 110*b* together using nuts. The curved portions 114*a*, 114*b* are configured to be received in recesses defined in the hull 70. The vertically spaced side apertures 116*a*, 116*b* are configured to receive screws which screw into the hull 70, thereby rigidly connecting the bracket 100 to the hull 70.

The upper part 120 has a lower portion 122 that extends vertically and forwardly from the arm connecting portions 112*a*, 112*b*, and an upper portion 124 that extends forwardly from the lower portion 122. A receiving aperture 126 is defined through the entirety of the upper part 120, and thus, is defined through both the lower and upper portions 122, 124. The receiving aperture 126 is aligned with the space defined by the recesses 117*a*, 117*b*. A left projection 128*a* and a right projection 128*b* (shown in FIG. 3) project toward one another from within the receiving aperture 126. The left and right projections 128*a*, 128*b* extend vertically throughout the receiving aperture 126. Also within the receiving aperture 126, a locking aperture 129 (shown in FIGS. 4A, 4B and 5B) that extends perpendicularly to the receiving aperture 126 is defined in the upper part 120. As will be described in more detail below, the receiving aperture 126 is configured to receive the tow pylon 200 therein, and the locking aperture 129, in conjunction with a lock 220 that will also be described below can lock the tow pylon 200 to the bracket 100.

The upper portion 124 has a rearward section 125*a*, an intermediate section 125*b* and a forward section 125*c*. The upper portion 124 is tapered from a portion of the intermediate section 125*b* to the rearward section 125*a*, whereas the forward section 125*c* is inclined downwardly from the intermediate section 125*b*. The receiving aperture 126 is defined in the rearward section 125*a*. The intermediate section 125*b* has a horizontally flat surface 130, and a navigation light attachment aperture 132 is defined on the horizontally flat surface 130. The navigation light attachment aperture 132 is configured to connect to a navigation light attachment (not shown). The intermediate section 125*b* also defines a secondary aperture 134 extending therethrough, and a slot 136 that extends laterally on a bottom side of the upper portion 124. The slot 136 is configured to receive a lower rail 92 of the barrier structure 90. The secondary aperture 134 is configured to receive a bolt therethrough to connect the secondary tow attachment 251 to the bracket 100, and to the barrier structure 90. The forward section 125*c* has a tab 138 that extends forwardly therefrom. The tab 138 defines two laterally spaced apertures 140 (only one shown) adapted to receive screws which screw into the deck 60, thereby rigidly connecting the bracket 100 to the deck 60.

Referring to FIGS. 2 to 6, the tow pylon 200, which is received in the receiving aperture 126, defines a left slot 202*a* and a right slot 202*b*. The left and right slots 202*a*, 202*b* extend vertically along the entirety of the tow pylon 200. As will be described in greater detail below, the left and right slots 202*a*, 202*b* are configured to receive the left and right projections 128*a*, 128*b* therein. A lower tow pylon aperture 204 and an upper tow pylon aperture 206 are defined in the tow pylon 200, within the right slot 202*b*. It is contemplated that in other embodiments, the lower and upper tow pylon apertures 204, 206 could be defined within the left slot 202*a*. The lower and upper tow pylon apertures 204, 206 are configured to receive different portions of the lock 220. The tow pylon 200 also defines an inner tow passage 210 (best seen in FIG. 5B), such that the tow pylon 200 is hollow, and thus, has a generally annular cross-section. Within the inner tow passage 210, the tow pylon 200 has front and rear reinforcing ribs 207*a*, 207*b* as well as four equally spaced ribs 208*a*, 208*b*, 208*c*, 208*d* that all extend from a top to a bottom of the inner tow passage 210 generally radially inwardly from an inner surface of the tow pylon 200. The front and rear reinforcing ribs 207*a*, 207*b* and the four equally spaced ribs 208*a*, 208*b*, 208*c*, 208*d* strengthen the tow pylon 200. Upper parts of the ribs 208*a*, 208*b*, 208*c*, 208*d* are configured to receive screws therein. Furthermore, the ribs 208*a*, 208*b* have lock receiving portions 209*a*, 209*b*. The upper surface of the tow pylon 200 has four connecting apertures (not shown) aligned with the ribs 208*a*, 208*b*, 208*c*, 208*d*, so that the tow attachment 250 can connect to the tow pylon 200.

Best seen in FIGS. 4A, 4B, 5A and 5B, the tow pylon 200 has the lock 220, which can be used to selectively lock the tow pylon 200 to the bracket 100. The lock 220 has an anchoring portion 222, a resilient portion 224, an engageable portion 226 and a locking portion 228. The anchoring portion 222 is anchored to the lock receiving portions 209*a*, 209*b*. The lock 220 has an initial position (shown in FIGS. 4A and 4B) where the engageable portion 226 extends through the upper tow pylon aperture 206 and the locking portion 228 extends through the lower tow pylon aperture 204. The resilient portion 224 is biased to return toward the initial position when deformed. Thus, when the engageable portion 226 is engaged, the engageable portion 226 and the locking portion 228 move inwardly, toward the anchoring portion 222, and when the engageable portion 226 is disengaged, the engageable portion 226 and the locking portion 228 move toward the initial position of the lock 220.

Figure 7:
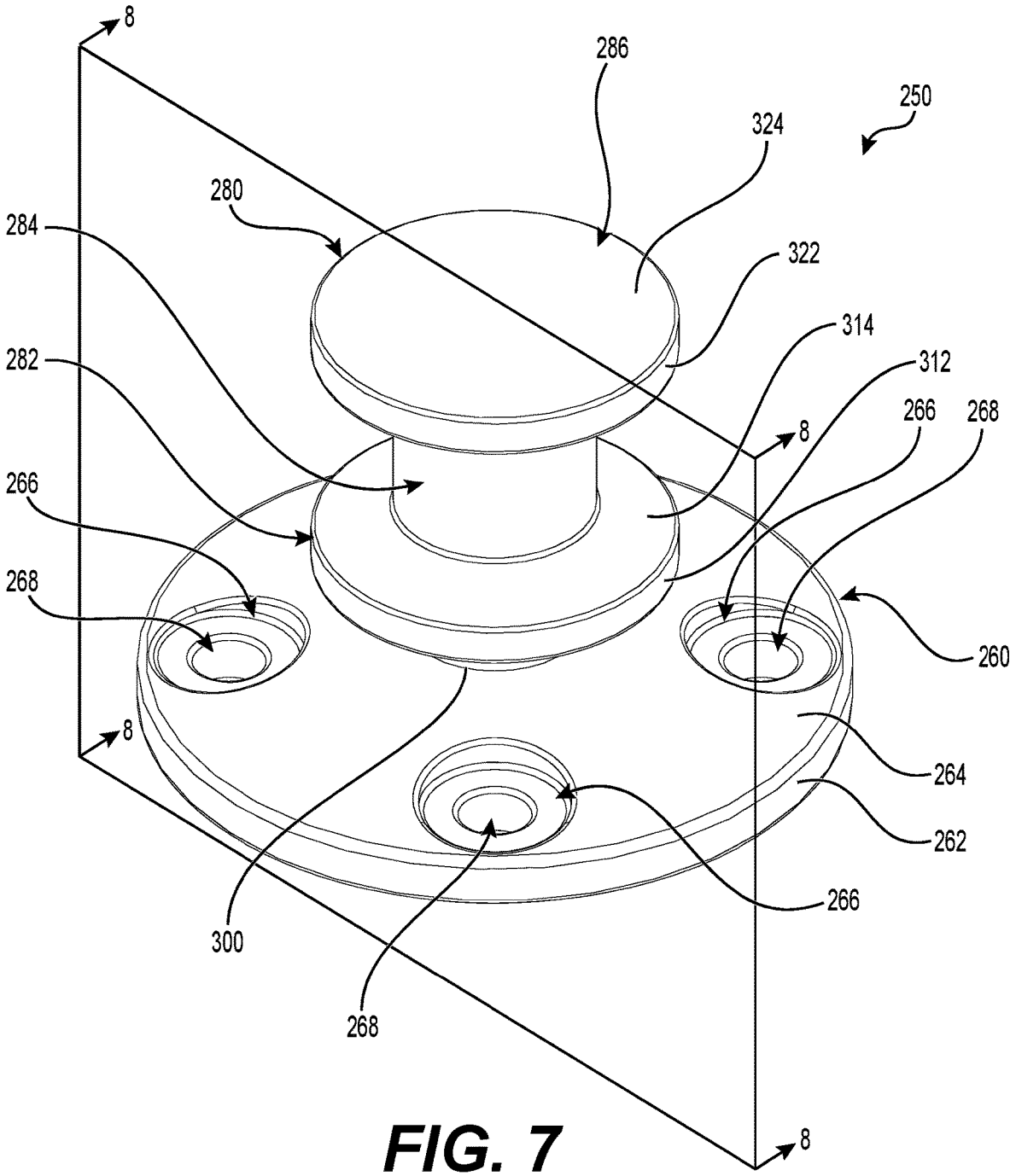
FIG. 7 is a perspective view taken from a rear, top, right side of the tow attachment of FIG. 1.
Figure 8:
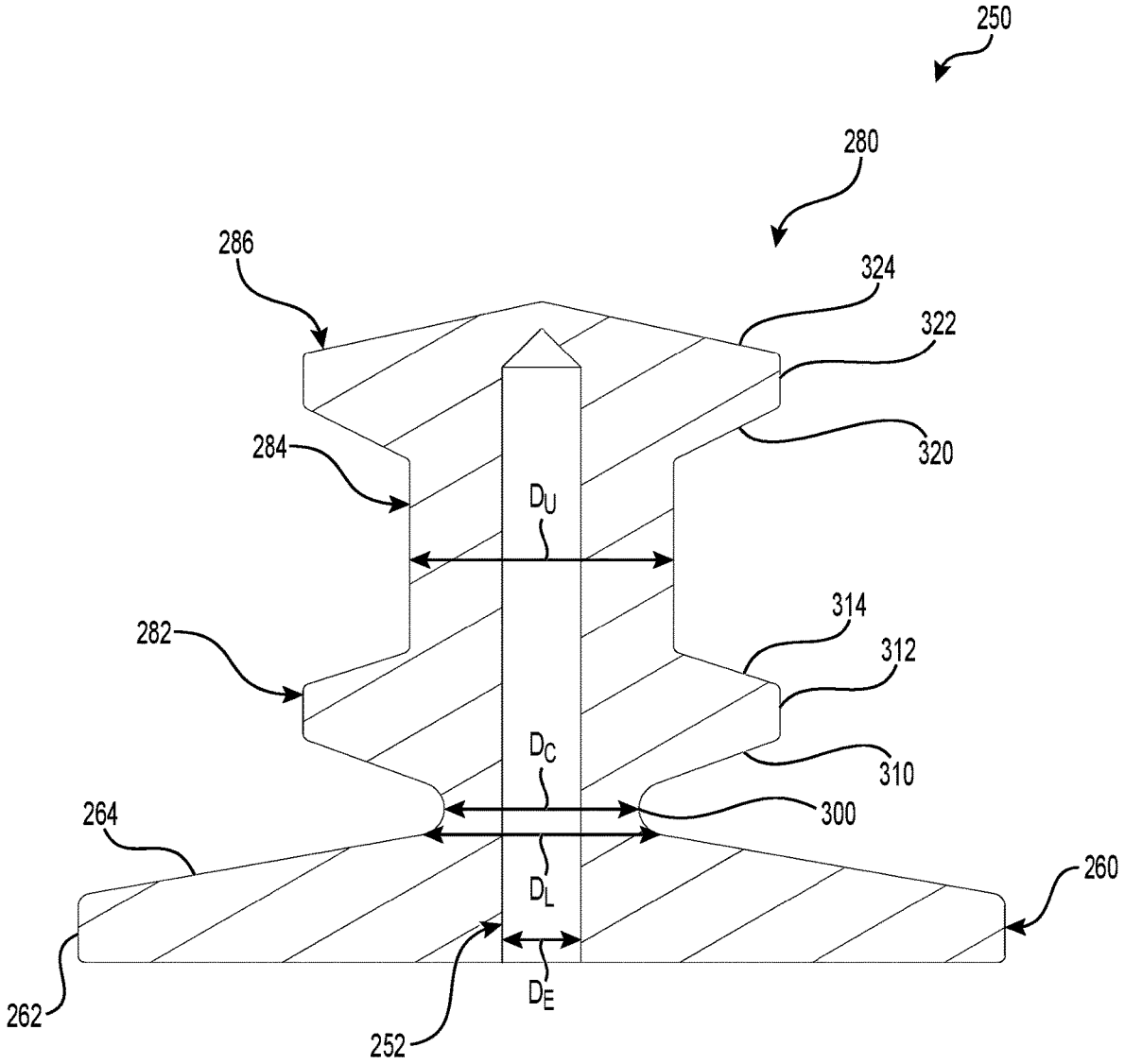
FIG. 8 is a cross-sectional view of the tow attachment of FIG. 7, taken through plane 8-8.
Figure 9:
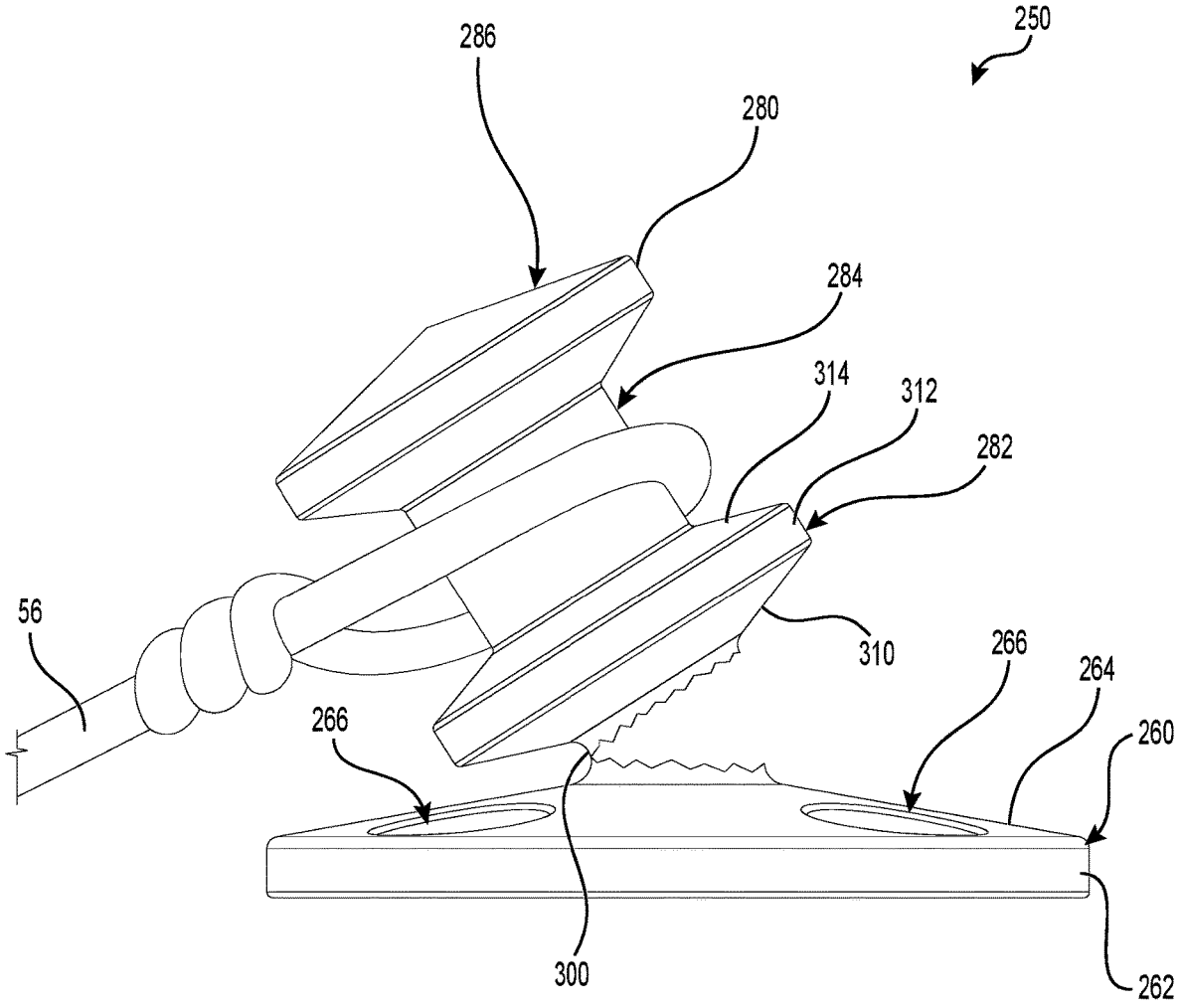
FIG. 9 is a right side elevation view of the tow attachment of FIG. 7 and a front portion of a tow rope, with an upper part of the tow attachment breaking away from a lower part of the tow attachment about a connecting portion.

Referring to FIGS. 7 to 9, the tow attachment 250 has a lower part 260 that is rigidly connected to the tow pylon 200 and an upper part 280. The upper part 280 is connected to the lower part 260 by a connecting portion 300. The lower part 260, the upper part 280 and the connecting portion 300 are integral, though in other embodiments, it is contemplated that the tow attachment 250 could be made of two or more separate parts. The tow attachment 250 defines a blind hole 252 that extends from a bottom surface of the lower part 260 to the upper part 280. It is contemplated that in some embodiments, the blind hole 252 could extend more or less into the tow attachment 250, could extend from a top surface of the upper part 280 to a bottom surface of the lower part 260, or could be a through hole or another type of hole. It is also contemplated that the blind hole 252 could be omitted. The blind hole 252 has an effective diameter DE, that is generally uniform along the vertical axis (excluding the tapered top portion of the blind hole 252).

The lower part 260 has a base portion 262 and a tapered portion 264, where the base portion 262 is connected to the connecting portion 300 by the tapered portion 264. Four equally spaced recesses 266 are defined in the tapered portion 264. A connecting aperture 268 is defined in each of the four equally spaced recesses 266. The base portion 262 is configured to rigidly connect to the tow pylon 200. More specifically, the connecting apertures 268 are configured to receive screws which screw into the top of the tow pylon 200, thereby rigidly connecting the tow attachment 250 to the tow pylon 200. It is contemplated that the tow attachment 250 could be connected to the tow pylon 200 differently. For instance, in some embodiments, the tow attachment 250 and the tow pylon 200 could be configured such that the tow attachment 250 has a threaded base portion 262 that screws into the tow pylon 200. Thus, it is contemplated that the tow attachment 250 could be selectively connected to the tow pylon 200. The base portion 262 has a generally uniform circular perimeter. The tapered portion 264 has a circular perimeter that becomes smaller as the circular perimeter nears the connecting portion 300. Thus, the circular perimeter of the tapered portion 264 varies along the vertical axis, such that the lower part 260 has a minimum lower part diameter $D_L$ where the lower part 260 meets the connecting portion 300. In addition, due to the blind hole 252, the lower part 260 has an annular cross-section for which the thickness, like the circular perimeter, also varies along the vertical axis. Therefore, a lower part wall thickness, which corresponds to the thickness of the annular cross-section, also varies along the vertical axis. Thus, the minimum lower part wall thickness corresponds to the smallest thickness of the lower part annular cross-section, which occurs at the minimum lower part diameter $D_L$.

The connecting portion 300 connects the lower and upper parts 260, 280, and has a circular perimeter that varies in the vertical direction. More precisely, the circular perimeter of the connecting portion 300 decreases from where the connecting portion 300 meets with the lower part 260 until a minimum connecting portion diameter $D_C$ is reached, and then increases until the connecting portion 300 meets with the upper part 280. In addition, due to the blind hole 252, the connecting portion 300 has an annular cross-section for which the thickness, like the circular perimeter, also varies along the vertical axis. Therefore, a connecting portion wall thickness, which corresponds to the thickness of the annular cross-section, also varies along the vertical axis. Thus, the minimum connecting portion wall thickness corresponds to the smallest thickness of the connecting portion annular cross-section, which occurs at the minimum connecting portion diameter $D_C$.

The upper part 280 extends upwardly from the connecting portion 300, and is configured to attach to the tow rope 56. In the present embodiment, the upper part 280 is a bollard 280. It is contemplated that in other embodiments, the upper part 280 could be a hook, a carabiner or another part that is suitable to attach a tow rope. The upper part 280 has a lower radially extending portion 282, an attaching portion 284, and an upper radially extending portion 286. It is contemplated that in some embodiments, the lower and upper radially extending portions 282, 286 could be omitted, such that the upper part 280 could consist of only the attaching portion 284. The lower radially extending portion 282 has a lower bottom tapered edge 310 that connects to the connecting portion 300, a lower intermediate portion 312 that has a generally uniform diameter, and a lower top tapered edge 314. The attaching portion 284 extends above the lower top tapered edge 314 of the lower radially extending portion 282, and has a generally uniform diameter. The tow rope 56 attaches to the tow attachment 250 around the attaching portion 284. The upper radially extending portion 286 has an upper bottom tapered edge 320 that connects to the attaching portion 284, an upper intermediate portion 322 that has a generally uniform diameter, and an upper top tapered edge 324. When the tow rope 56 is attached to the attaching portion 284, the lower and upper radially extending portions 282, 286 limit how much the tow rope 56 can slide along the upper part 280. Furthermore, the upper radially extending portion 286 also helps to keep the tow rope 56 from sliding off the upper part 280.

The upper part 280 has a circular perimeter that, given the shape thereof, varies along the vertical axis. A minimum upper part diameter $D_U$ occurs at, and extends along, the attaching portion 284. It is contemplated that in other embodiments the minimum upper part diameter $D_U$ could occur elsewhere along the upper part 280. In addition, due to the blind hole 252, the upper part 280 has an annular cross-section for which the thickness, like the circular perimeter, also varies along the vertical axis. Therefore, an upper part wall thickness, which corresponds to the thickness of the annular cross-section, also varies along the vertical axis. Thus, the minimum upper part wall thickness corresponds to the smallest thickness of the upper part annular cross-section, which occurs at the minimum upper part diameter $D_U$.

The tow attachment 250 is a mechanical sacrificial part. More precisely, the connecting portion 300 defines the mechanical sacrificial part. If excessive load is applied to the upper part 280 by the tow rope 56, the upper part 280 breaks away from the lower part 260 about the connecting portion 300, thereby preventing damage to the boat 50 and the tow pylon 200. The break occurs at the connecting portion 300, because the tow attachment 250 is configured as such. Indeed, the connecting portion 300 has a lower breaking strength than the lower and upper parts 260, 280 as well as the tow pylon 200 and the tow rope 56. Additionally, the minimum connecting portion diameter $D_C$ is smaller than the minimum lower part diameter $D_L$ and the minimum upper part diameter $D_U$, and the minimum connecting portion wall thickness is smaller than the minimum lower part wall thickness and the minimum upper part wall thickness. It is understood that in some embodiments, only one of the above-mentioned features could be present. In other embodiments, any combination of the above-mentioned features could be present. For instance, in some embodiments, the minimum connecting portion diameter $D_C$, the minimum lower part diameter $D_L$ and the minimum upper part diameter $D_U$ could all be the same, but the connecting portion 300 could have a lower breaking strength than the lower and upper parts 260, 280. The connecting portion 300 will break under a mix of shear and torsional loading applied by the tow rope 56 at the attaching portion 284. It is further contemplated that in some embodiments, the tow attachment 250 could be configured to break only in shear, compression, tension, bending or torsion, or in any combination thereof. In an embodiment designed to break in tension, the connecting portion 300 could have lower tensile strength than the lower and upper parts 260, 280. Likewise, in an embodiment designed to break in shear, the connecting portion 300 could have lower shear strength than the lower and upper parts 260, 280. It is also further contemplated that in some embodiments, none of the above-mentioned features could be present such that the connecting portion 300 does not define a mechanical sacrificial part. Instead, in such embodiments, the upper part 280 disconnects from the lower part 260 when excessive loads are applied to the upper part 280 in a non-destructive fashion. For instance, the connecting portion 300 could be a self-releasing latch that opens to release the tow rope at when an excessive load is applied thereto.

Though in the present embodiment, the tow attachment 250 is connected to the tow pylon 200, which is connected to the bracket 100, it is contemplated that in other embodiments, the tow pylon 200 and the bracket 100 could be omitted. In such embodiments, the tow attachment 250 could be rigidly connected directly to the boat 50.

Figure 6:
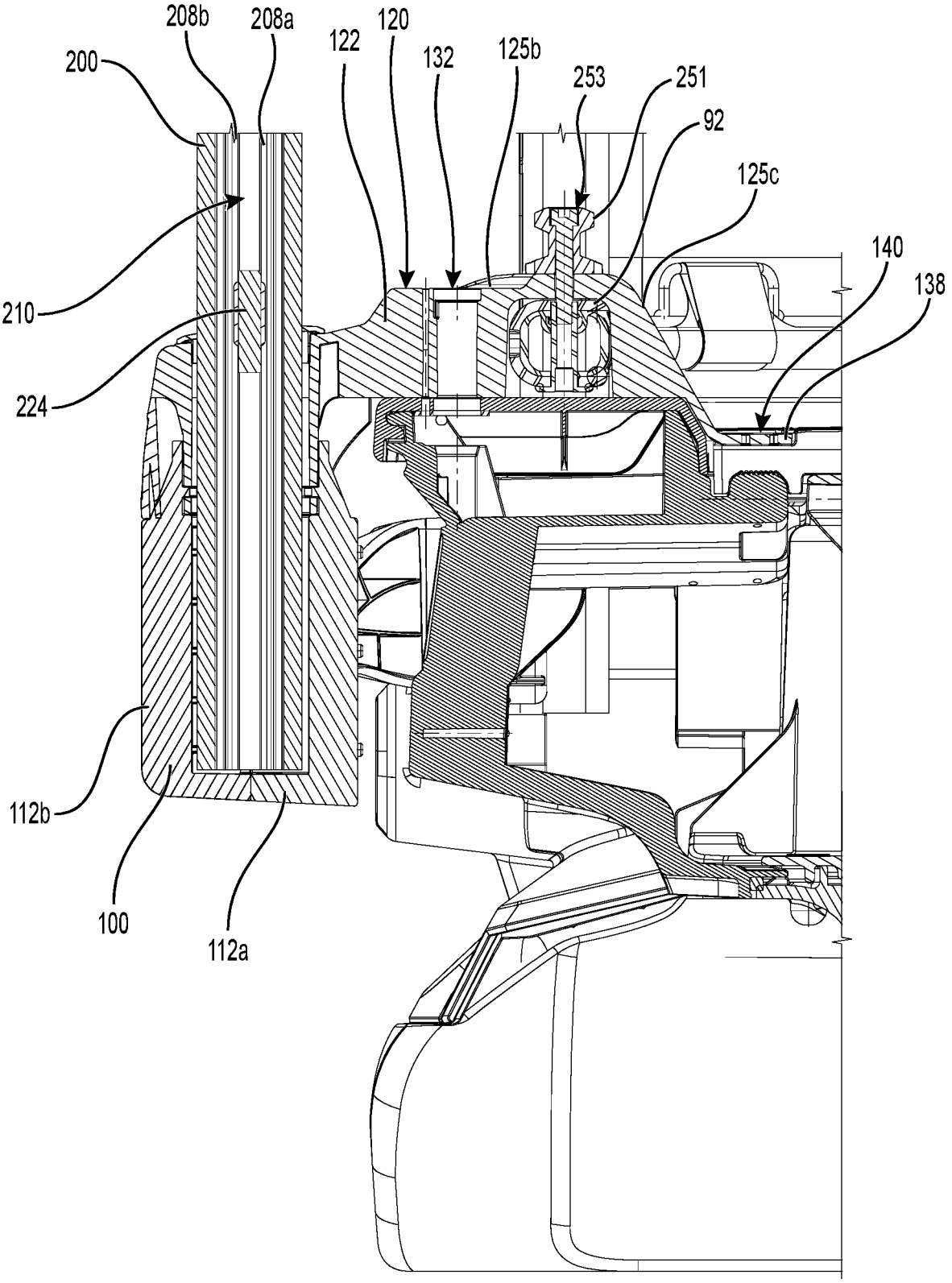
FIG. 6 is a cross-sectional view of a portion of the watercraft and the tow pylon assembly of FIG. 1, taken through plane 6-6 of FIG. 1.

The tow pylon assembly 55 also has the secondary tow attachment 251 (shown in FIGS. 1 and 6). The secondary tow attachment 251 defines an aperture 253 configured to receive a screw therethrough, to connect to the bracket 100. The secondary tow attachment 251 is intended for use when the tow pylon assembly 55 has been removed from the bracket 100.

Figure 10:
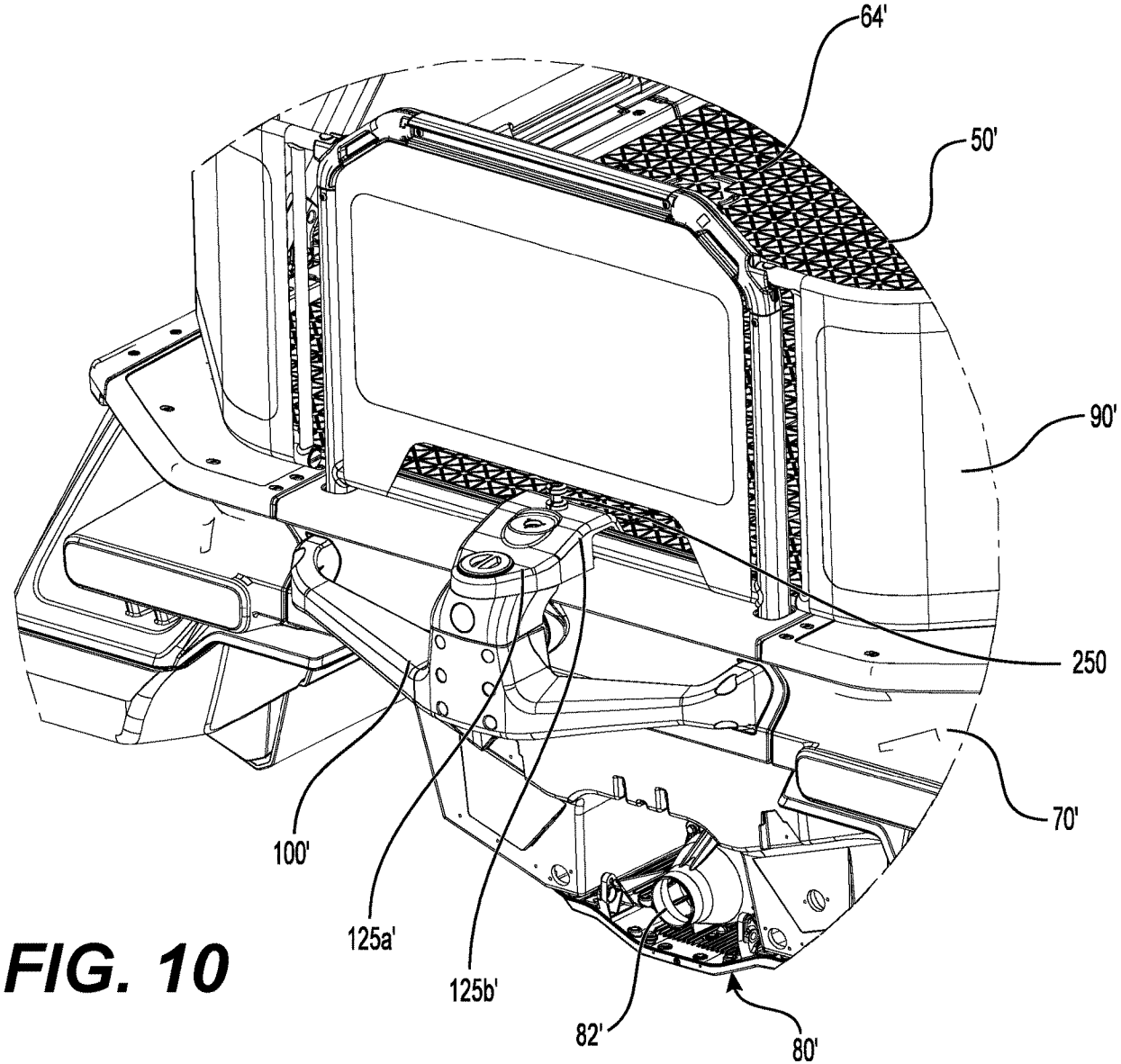
FIG. 10 is a close-up perspective view taken from a rear, top, right side of the watercraft of FIG. 1, with an alternative embodiment of the tow attachment of FIG. 1 connected thereto.

Referring to FIG. 10, an alternate embodiment of the present technology will now be described. In this alternate embodiment, the secondary tow attachment 251 is omitted, and is replaced by the tow attachment 250. which is directly and rigidly connected to the bracket 100' at the intermediate section 125*b*', and thus the tow attachment 250 is connected to the hull 70' of the boat 50'. In this alternate embodiment, the bracket 100' is similar to the bracket 100, except in that the secondary aperture 134 is replaced by four apertures (not shown) in the bracket 100' so that the tow attachment 250 can connect to the bracket 100'.

Referring particularly to FIGS. 1, 3, 4A, 4B and 9, the present technology in use will now be described with reference to the tow pylon assembly 55.

The tow pylon 200 to which the tow attachment 250 is rigidly connected, is removably connected to the bracket 100, such that when not in use, the tow pylon 200, and thereby the tow attachment 250, can be stored on the boat 50. It is contemplated that in some embodiments, the tow pylon 200 could be permanently connected to the bracket 100.

To connect the tow pylon 200 to the bracket 100, the tow pylon 200 is inserted in the receiving aperture 126 such that the left and right projections 128*a*, 128*b* are respectively received in the left and right slots 202*a*, 202*b*. The left and right projections and slots 128*a*, 128*b*, 202*a*, 202*b* prevent the tow pylon 200 from rotating about the vertical axis thereof. The tow pylon 200 can be inserted in the receiving aperture 126 until the locking portion 228 abuts the upper part 120 of the bracket 100. At this point, the engageable portion 226 is engaged, which results in the locking portion 228 moving inwardly until the locking portion 228 no longer abuts the upper part 120. Thus, the tow pylon 200 can be further inserted into the receiving aperture 126. Once the locking portion 228 is in the receiving aperture 126, the engageable portion 226 is disengaged, resulting in the resilient portion 224 biasing the lock 220 to return to the initial position of the lock 220, thus pushing the locking portion 228 outwardly. A bottom portion of the tow pylon 200 is eventually received in the space defined by the recesses 117*a*, 117*b* of the left and right arm connecting portions 112*a*, 112*b*, and ultimately reaches a final position when a bottom of the tow pylon 200 abuts the left and right arm connecting portions 112*a*,112*b*, and the locking portion 228 is received in the locking aperture 129, thereby locking the tow pylon 200 in position. To disconnect the tow pylon 200 from the bracket 100, the engageable portion 226 should be engaged, thereby removing the locking portion 228 from the locking aperture 129, before removing the tow pylon 200 from the receiving aperture 126.

Once the tow pylon assembly 55 is assembled and ready to be used, one end of the tow rope 56 is attached to the attaching portion 284 of the tow attachment 250. The other end of the tow rope 56 can be used for a variety of tow activities. The elevated configuration of the tow pylon 200 offers a higher tow position that can be desirable for some tow activities.

When the tow activities are being performed, the tow rope 56 applies a generally rearward load to where the tow rope 56 is connected, thus to the upper part 280 of the tow attachment 250. When the tow rope 56 applies a load above a predetermined load to the upper part 280, the upper part 280 breaks away from the lower part 260 about the connecting portion 300 as shown in FIG. 9. In one embodiment, the predetermined load is 700 lbs, and is applied perpendicularly to the attaching portion 284 at a midpoint thereof. It is contemplated that in other embodiments, the predetermined load at which the upper part 280 breaks away from the lower part 260 could be more or less than 700 lbs. As mentioned above, in some embodiments, the upper part 280 could disconnect from the lower part 260 about the connecting portion 300 in a non-destructive manner.

Figure 11:
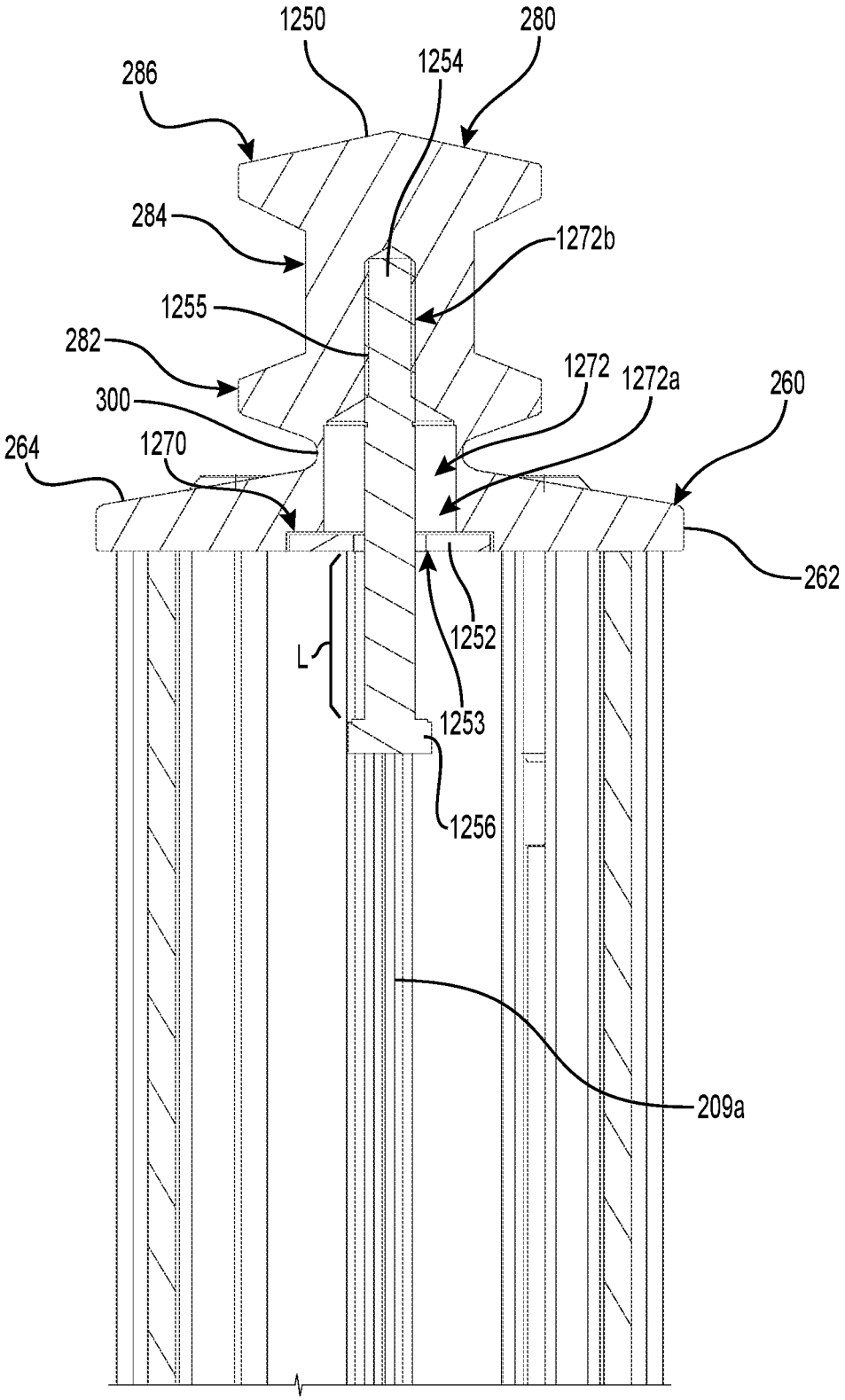
FIG. 11 is a cross-sectional view of an alternative embodiment of the tow attachment of FIG. 1 connected to a portion of the tow pylon assembly of FIG. 1.
Figure 12:
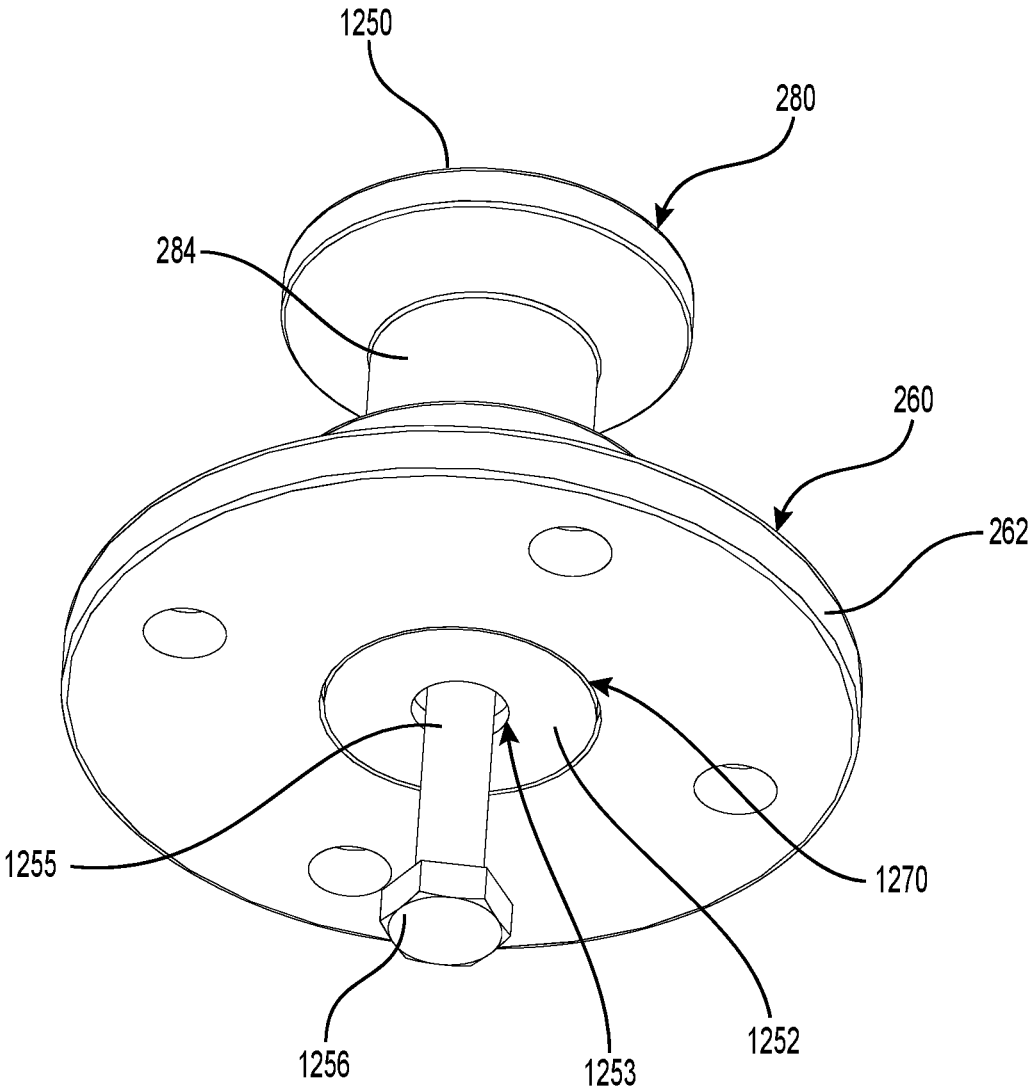
FIG. 12 is a perspective view taken from a rear, bottom, right side of the tow attachment of FIG. 11.

Referring to FIGS. 11 and 12, an alternative embodiment of the tow attachment 250, namely tow attachment 1250. In FIG. 11, the tow attachment 250 is connected to the tow pylon 200. In the present embodiment, the tow attachment 1250 includes a stopping member 1252 and a retaining member 1254. Features of the tow attachment 1250 that are similar to those of the tow attachment 250 have been labeled with the same reference numerals, and will not be described in detail again herewith. Although the tow attachment 1250 is shown connected to the tow pylon 200, it is contemplated that in some embodiments, the tow attachment 1250 could be directly connected to a bracket in a manner similar to the way the tow attachment 250 is connected to the bracket 100' as described above with respect to FIG. 10.

The lower part 260 of the tow attachment 1250 defines, in the base portion 262, a lower recess 1270. The lower recess 1270 extends from the bottom surface of the base portion 262 upwardly, and is configured to, as will be described below, receive the stopping member 1252. It is contemplated that in some embodiments the lower recess 1270 could be omitted. In the present embodiment, within the lower recess 1270, the lower part 260 defines, instead of the blind hole 252, a lower hole 1272*a* and an upper hole 1272*b*. The lower hole 1272*a* extends vertically above the connecting portion 300 and the upper hole 1272*b* extends within the upper part 280. The upper hole 1272*b* has a smaller diameter than the lower hole 1272*a*. In some embodiments, the upper and lower holes 1272*a*, 1272*b* could be replaced by a hole having a constant diameter (i.e., the hole 1272 could be similar to the blind hole 252). In the present embodiment, the upper hole 1272*b* has internal threads. It is contemplated that in some embodiments, the threads could be omitted.

The stopping member 1252 is received in the lower recess 1270 such that the stopping member 1252 is disposed vertically below the connecting portion 300. The stopping member 1252 is a washer defining an aperture 1253 at a center thereof. Thus, the stopping member 1252 has an annular shape. As will be described below, the aperture 1253 is configured to only receive a portion of the retaining member 1254 therethrough. When the tow attachment 1250 is connected to the tow pylon 200, the stopping member 1252 is retained within the lower recess 1270 by abutting with both the base 262 of the tow attachment 250 and a top of the lock receiving portions 209*a*, 209*b* of the tow pylon 200. It is contemplated that in other embodiments, the stopping member 1252 could be integral with the tow attachment 1250. It is understood that in such embodiments, the lower recess 1270 is omitted.

The retaining member 1254 has a connecting portion 1255 and a retaining portion 1256. The connecting portion 1255 is received through the aperture 1253 of the stopping member 1252 and connects to the upper part 280 of the tow attachment 1250. The connecting portion 1255 has external threads complementary with the internal threads of the upper hole 1272*b*. The connecting portion 1255 is configured so that once the connecting portion 1255 is connected to the upper part 280 and the tow attachment 250 is connected to the tow pylon 200, the retaining portion 1256 is vertically spaced from a bottom surface of the stopping member 1252 by a length L. In some embodiments, the length L is about 1 inch. In other embodiments, the length L could be greater or smaller than 1 inch. For instance, length L could be about 0.75 inches or about 0.5 inches. In other embodiments, length L could be about 1.25 inches or about 1.5 inches. The retaining portion 1256 is sized to be larger than the aperture 1253. In the present embodiment, the retaining member 1254 is a fastener, and more specifically a bolt. As such that the connecting portion 1255 is a threaded portion of the bolt and the retaining portion 1256 is a head of the bolt. Other retaining members 1254 are contemplated. For instance, in other embodiments, the connecting portion 1255 could be a cable configured to connect to the upper part 280 of the tow attachment 1250 and to the retaining portion 1256, and the retaining portion 1256 could be an anchor configured to abut the stopping member 1252 or at least being sized to be larger than the aperture 1253. It is also contemplated that in other embodiments the retaining member 1254 could be integral with the tow attachment 1250.

In operation, like for the tow attachment 250, when the tow rope 56 is connected to tow attachment 1250, and the tow rope 56 applies a load above a predetermined load to the upper part 280, the upper part 280 breaks away from the lower part 260 about the connecting portion 300. As the broken off upper part 280 is moving away from the lower part 260, the retaining portion 1256, which is connected to the upper part 280 by the connecting portion 1255, moves toward the stopping member 1254, and eventually abuts the stopping member 1252, thereby limiting by how much the upper part 280 can move away from the lower part 260. More precisely, the retaining portion 1256, after crossing the length L, abuts a bottom surface of the stopping member 1252, which is still connected to the tow pylon 200, because the aperture 1253 is smaller than the retaining portion 1256. Thus, the stopping member 1252 and the retaining member 1254 provide a way for the upper part 280 to stay retained to the lower part 260 after the lower and upper parts 260, 280 have disconnected. In some instances, the length L is long enough so that upper part 280 falls away such that the tow rope 56 can slide off from the upper part 280.

It is contemplated that in some embodiments, the stopping member 1252 could be omitted. In such embodiments, the tow attachment 1250 defines the blind hole 252 that is sized to only receive the connecting portion 1255 therein. The retaining portion 1256 is sized to be larger than the blind hole 272 such that the retaining portion 1256 abuts the bottom surface of the base 262 upon disconnection of the lower and upper parts 260, 280.

Modifications and improvements to the above-described embodiments of the present technology may become apparent to those skilled in the art. The foregoing description is intended to be exemplary rather than limiting. The scope of the present technology is therefore intended to be limited solely by the appended claims.

What is claimed is:

1. A tow attachment for a watercraft, the tow attachment being configured to attach a tow rope to the watercraft, the tow attachment comprising:
   - a first part being configured for rigid connection to the watercraft; and
   - a second part connected to the first part by a connecting portion,
   - the second part being configured to attach to the tow rope, and
   - the second part disconnects from the first part about the connecting portion in response to the tow rope applying a load above a predetermined load to the second part.

2. The tow attachment of claim 1, wherein the connecting portion defines a mechanical sacrificial part such that the second part breaks away from the first part about the connecting portion in response to the tow rope applying the load above the predetermined load to the second part.

3. The tow attachment of claim 2, wherein the connecting portion has a lower breaking strength than the first and second parts.

4. The tow attachment of claim 1, wherein the first part, the second part and the connecting portion are integral.

5. The tow attachment of claim 1, wherein the second part is a bollard.

6. The tow attachment of claim 1, wherein:

the first part, the second part, and the connecting portion each have a circular perimeter; and a minimum diameter of the connecting portion is smaller than minimum diameters of the first and second parts.

7. The tow attachment of claim 1, wherein a minimum wall thickness of the connecting portion is smaller than minimum wall thicknesses of the first and second parts.

8. The tow attachment of claim 7, wherein:

the first part, the second part, and the connecting portion each have annular cross-sections; and the minimum wall thickness of the connecting portion corresponds to a smallest thickness of the annular cross-section of the connecting portion;

the minimum wall thickness of the first part corresponds to a smallest thickness of the annular cross-section of the first part; and the minimum wall thickness of the second part corresponds to a smallest thickness of the annular cross-section of the second part.

9. The tow attachment of claim 1, further comprising a retaining member having a connecting portion connected to the second part, and a retaining portion; and wherein in response to the second part disconnecting from the first part, the retaining portion engages the tow attachment for limiting movement of the second part relative to the first part.

10. The tow attachment of claim 9, further comprising a stopping member disposed at a bottom of the first part, the stopping member defining an aperture, the aperture receiving the connecting portion of the retaining member; and wherein, in response to the second part disconnecting from the first part, the retaining portion engages the stopping member for limiting movement of the second part relative to the first part.

11. A watercraft comprising:

a hull;

a deck disposed on the hull, and the tow attachment of claim 1 connected to at least one of the hull and the deck.

12. The watercraft of claim 11, further comprising a tow pylon connected to the at least one of the hull and the deck; and the first part of the tow attachment is rigidly connected to the tow pylon.

13. The watercraft of claim 12, further comprising a bracket connected to the at least one of the hull and the deck; and wherein the tow pylon is connected to the bracket.

14. The watercraft of claim 13, wherein the tow pylon is removably connected to the bracket, and the tow pylon has a lock that selectively locks the tow pylon to the bracket.

15. A tow pylon assembly for a watercraft comprising:

a tow pylon; and a tow attachment connected to the tow pylon, the tow attachment being configured to attach a tow rope to the watercraft, and the tow attachment including:

a first part being configured for rigid connection to the tow pylon; and a second part connected to the first part by a connecting portion, the second part being configured to attach to the tow rope, and the second part disconnects from the first part about the connecting portion in response to the tow rope applying a load above a predetermined load to the second part.

16. The tow pylon assembly of claim 15, wherein the connecting portion defines a mechanical sacrificial part such that the second part breaks away from the first part about the connecting portion in response to the tow rope applying the load above the predetermined load to the second part.

17. The tow pylon assembly of claim 16, wherein the connecting portion has a lower breaking strength than the first part, the second part and the tow pylon.

18. The tow pylon assembly of claim 15, further including a bracket configured to be connected to at least one of a hull and a deck of the watercraft; and wherein the tow pylon is connected to the bracket.

19. A watercraft comprising:

a hull;

a deck disposed on the hull, and the tow pylon assembly of claim 15 connected to at least one of the hull and the deck.

20. The tow attachment of claim 1, wherein the load causes a shearing effect between the first part and the second part.

21. The tow pylon assembly of claim 15, wherein the load causes a shearing effect between the first part and the second part.

22. The tow attachment of claim 1, wherein the first part is spaced from the second part, and the connecting portion is disposed between the first part and the second part.

* * * * *